United States Patent [19]

Frauenfelder

[11] 4,240,810

[45] Dec. 23, 1980

[54] COLLECTING ELECTRODE PLATE ASSEMBLY

[75] Inventor: Alfred Frauenfelder, Zollikerberg, Switzerland

[73] Assignee: ELEX-AAF AG, Zurich, Switzerland

[21] Appl. No.: 39,743

[22] Filed: May 16, 1979

[51] Int. Cl.[3] ..... B03C 3/47

[52] U.S. Cl. ..... 55/143; 55/145; 55/113

[58] Field of Search ..... 55/130, 141, 143, 145, 55/156, 113; 52/470

[56] References Cited

U.S. PATENT DOCUMENTS

| | | | |
|---|---|---|---|
| 2,189,159 | 2/1940 | Anschicks | 52/470 |
| 2,737,258 | 3/1956 | Harlow | 55/145 |
| 2,753,962 | 7/1956 | McBerty | 52/470 |
| 2,996,144 | 8/1961 | Phyl | 55/156 |
| 3,660,968 | 5/1972 | Dyla et al. | 55/156 |
| 3,748,831 | 7/1973 | Lagerdahl et al. | 55/156 |
| 4,007,023 | 2/1977 | Bätza et al. | 55/143 |
| 4,058,377 | 11/1977 | Schminke et al. | 55/156 |

FOREIGN PATENT DOCUMENTS

| | | | |
|---|---|---|---|
| 937925 | 9/1963 | United Kingdom | 55/130 |

*Primary Examiner*—David L. Lacey

*Attorney, Agent, or Firm*—Thomas G. Anderson

[57] ABSTRACT

A collecting electrode plate assembly for a flow-through housing of an electrical precipitator wherein each collecting electrode is made up of aligned panels interconnected by guide arrangements spanning the junctures of the adjacent panels. Each guide arrangement includes a pair of opposing plates secured to one of the panels and outwardly embracing an adjacent panel to accommodate relative lateral movement between adjacent panels while retaining the panels in a common plane.

11 Claims, 8 Drawing Figures

COLLECTING ELECTRODE PLATE ASSEMBLY

BACKGROUND OF THE INVENTION

1. Field of Invention

The present invention relates to gas separation devices and in particular to collector electrode assemblies for electrostatic precipitators.

2. Description of the Prior Art

The prior art includes a variety of modular or unitized collector electrode assemblies for electrostatic precipitators. For example, U.S. Pat. No. 3,616,605 discloses a modular electrode assembly having a plurality of laterally adjacent collecting electrodes interconnected to form a collector wall extending along the direction of gas flow in an electrical precipitator. Other modularized collector wall arrangements have provided for a plurality of adjacent electrode panels supported to accommodate relative lateral movement between adjacent panels during rapping or collector cleaning operations. However, in the case of particularly large panels such as those necessary for the precipitators used in electrical utilities, modularized collector walls of this type are often damaged during shipment, are difficult to assemble in the field, and are susceptable to bowing and warping which results in misalignment of the collector wall within the precipitator.

SUMMARY OF THE INVENTION

The present invention relates to a modular or unitized collector electrode wall or plate assembly for an electrostatic precipitator.

The wall assembly includes a plurality of adjacent generally identical sections or panels which can be readily assembled in the field. The panels of the wall are pivotally suspended from a common upper support and are laterally spaced one from the other to promote accentuated panel vibration during electrode rapping or cleaning operations. The adjacent edge portions of the panels are interconnected by one or more guide or retaining assemblies accommodating relative lateral movement between the adjacent edge portions while retaining the panels in a common plane. Each guide assembly preferably includes a pair of transversely spaced plates mechanically secured to a respective edge portion and extending laterally therefrom to overlap and embrace an opposing adjacent edge portion. Each plate includes one or more inwardly extending clips or fingers connecting the plate to one of the edge portions of the panel whereat the plate is secured in position by a locking tab or wing portion protruding from the panel.

It is to be understood that various changes can be made in the arrangement, form and scope of the present disclosure without departing from the scope or spirit of the invention.

DESCRIPTION OF THE PREFERRED EMBODIMENT

Figure 2:
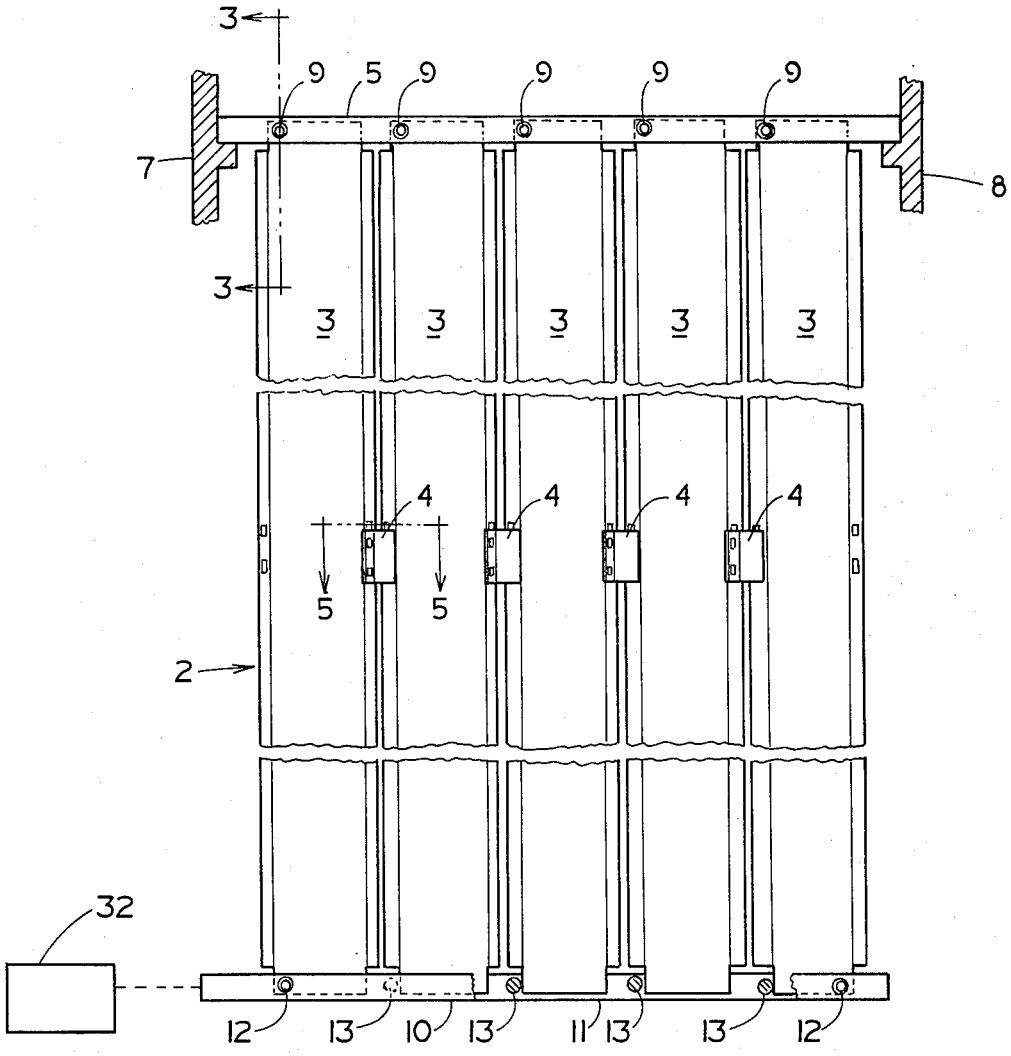
FIG. 2 is a side elevational view of one of the collector electrode walls shown in FIG. 1.
Figure 3:
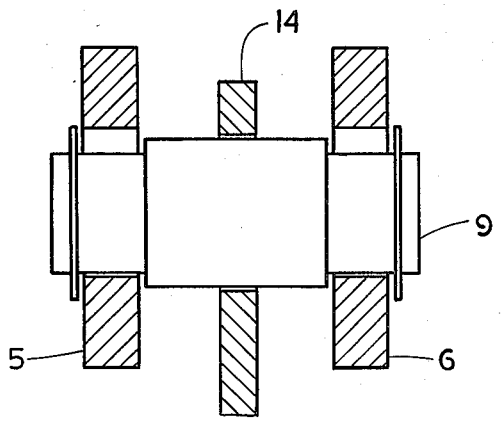
FIG. 3 is an enlarged cross-sectional view taken generally along line 3—3 in FIG. 2.

As shown in the drawings, the collecting electrode assembly 1 embodying the present invention includes a plurality of transversely spaced collector walls 2 adapted to extend laterally of a flow-through housing in an electrostatic precipitator parallel to the direction of air flow. The walls each include a series of spaced collecting panels 3 extending in successive alignment and being connected by guide plate arrangements 4 which accommodate relative lateral movement between adjacent panels as will hereafter be described. The panels, which in some utility installations may be 30 to 40 feet long, are suspended from a pair of upper support beams 5 and 6 supported by the precipitator walls 7 and 8 on pins 9 pivotally connecting the upper ends of the panels to the upper beams as shown in FIGS. 2 and 3. The lower ends of the panel are similarly contained and positioned between a pair of laterally reciprocable lower beams 10 and 11. The outermost panels are pivotally connected to the lower beams by pins 12 and the remaining intermediate panels are retained in position by pins or stops 13 extending between the lower beams. The pins 12 and stops 13 are connected to the lower beams 10 and 11 in substantially the same manner as the pins 9 are secured to the upper beams 5 and 6 as shown in FIG. 3.

Figure 1:
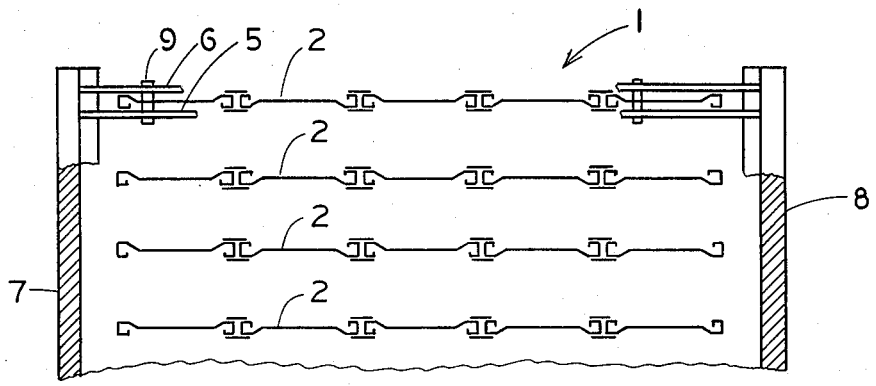
FIG. 1 is a top plan view of the precipitator collector electrode construction embodying the invention.
Figure 4:
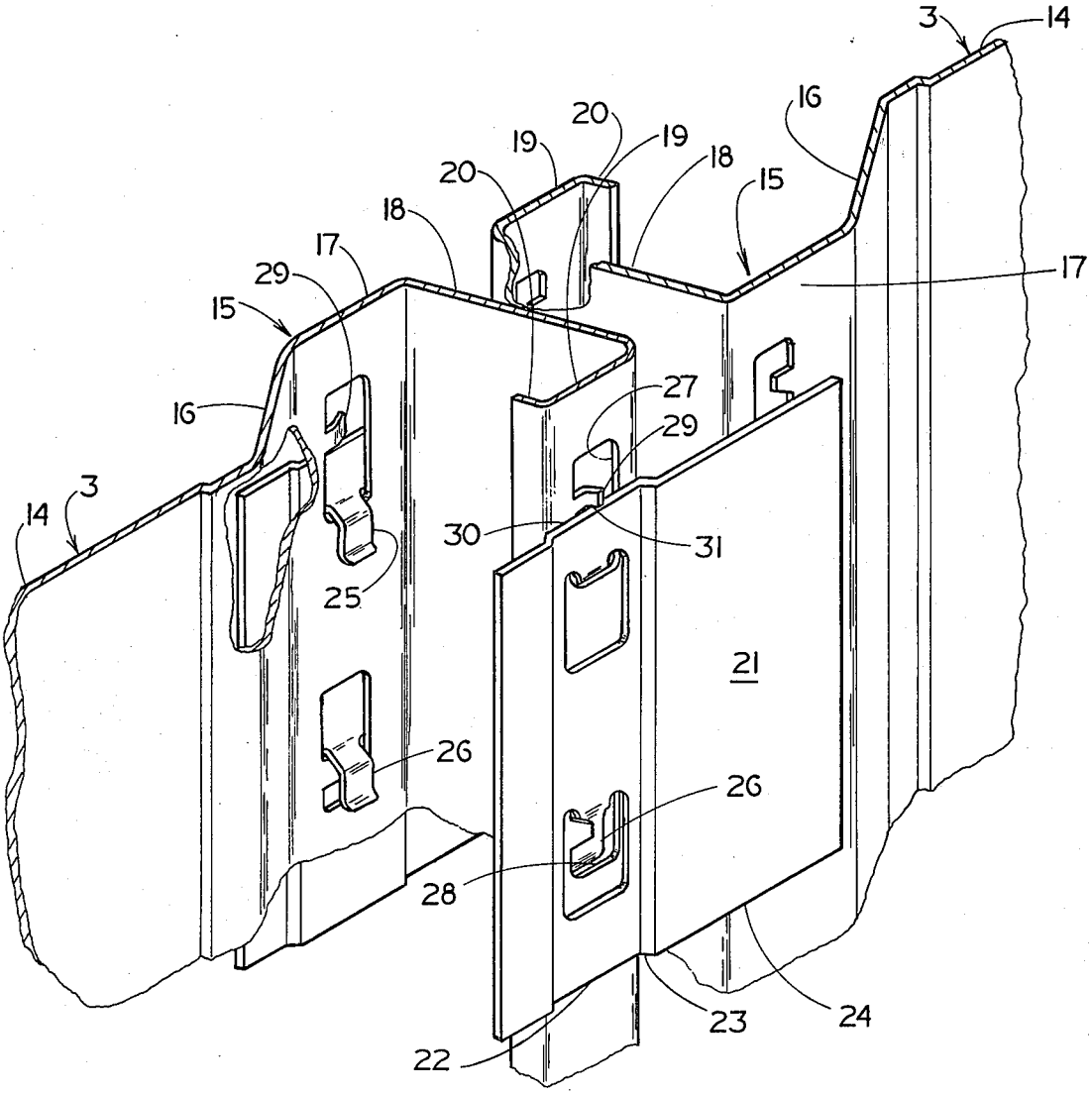
FIG. 4 is an isometric view, partially in section, showing the guide plates of the guide assembly on one of the collector panels.
Figure 5:
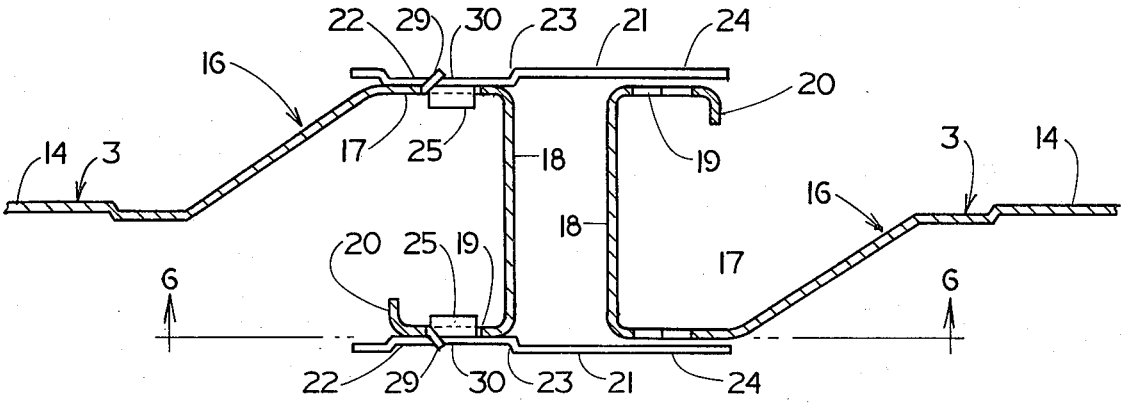
FIG. 5 is an enlarged plan sectional view taken generally along line 5—5 in FIG. 2.

As best seen in FIGS. 1, 4 and 5, the panels 3 are of a channel-like configuration and are positioned along the length of the collector wall 2 to alternately open toward opposite sides of the collector wall. Each panel includes a central web section 14 and J-shaped edge stiffening sections or beam members 15 extending from the sides of the central web 14. Each edge stiffening section 15 includes a diagonal connecting wall 16 extending to a first lateral wall section 17 on one side of the panel which in turn is connected by a transverse edge wall 18 to a second lateral wall 19 opposing the first lateral wall on the other side of the panel and including an inwardly extending reinforcing flange 20 as shown in the drawings. It should be noted that the lateral walls 17 and 19 are spaced substantially equidistant from the common vertical plane defined by the panel web sections 14 extending the breadth of the collector wall to promote balanced lateral load transfer between the panels during precipitator operations as well as accommodating interchangability of the panels to simplify assembly in the field.

As shown in the drawings, one or more guide plate arrangements 4 are provided at the juncture of each of the successive panels which connect the adjacent edge sections 16 to arrest or restrain lateral warping and end-to-end bowing of the panels. This is particularly important in the case of very long panels such as those in power plant applications.

Figure 6:
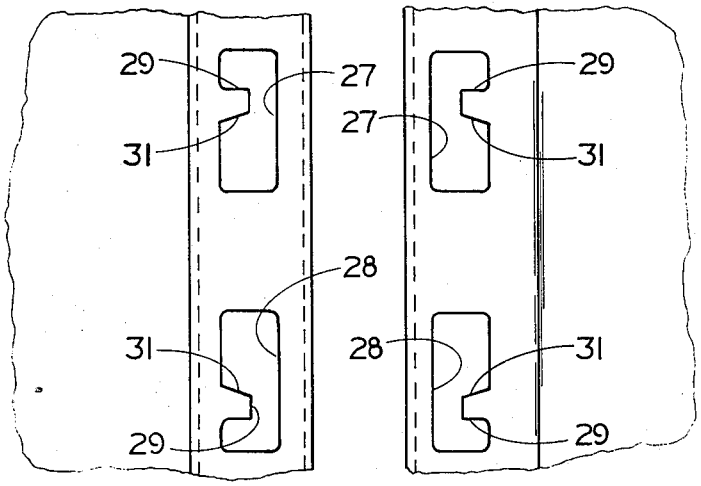
FIG. 6 is a side elevational view taken generally along line 6—6 in FIG. 5 showing the guide plates removed.
Figure 7:
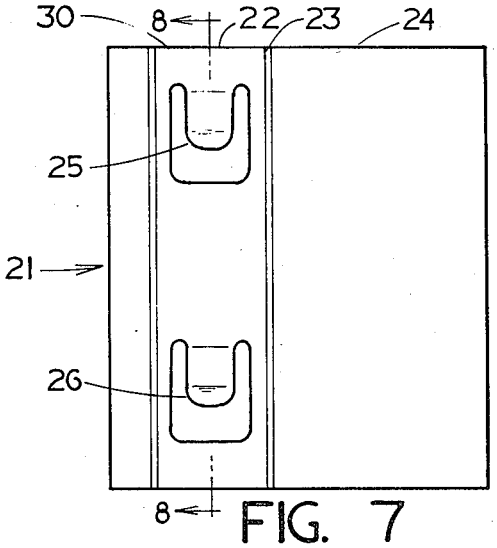
FIG. 7 is a side elevational view of the guide plate.
Figure 8:
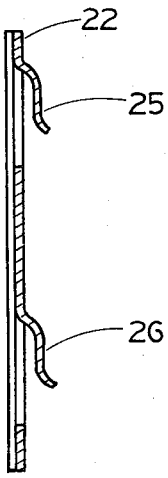
FIG. 8 is a cross-sectional view taken generally along line 8—8 in FIG. 7.

The guide plate arrangement 4 includes a pair of laterally extending guide plates 21 which are mechanically secured to one of the adjacent edge stiffening sections 15 and overlie the sides of the other edge sections to restrain relative transverse movement between adjacent panels. Each guide plate 21 is preferrably of a stamped unitary plate construction and includes a central plate attachment portion 22 connected by a rigidifying bent portion 23 to a laterally extending retaining flange or entraining section 24. As shown in the drawings, the retaining flange is outwardly or transversely offset from the central plate portion 22 to accommodate ease of assembly within the predetermined tolerance limitations of the collector wall. As noted above, plates 21 are secured to one of the edge stiffening sections 15 by upper and lower connecting clip portions or fingers 25 and 26 inwardly protruding from the central plate portion 22 and extending along the length of the respective beams 15, although the invention also contemplates the use of bolts, rivets or similar mechanical couplings for this purpose. The fingers 25 and 26 are removably secured to the wall sections 17 and 19 through upper and lower plate attachment slots or holes 27 and 28, respectively; and, to lock the plates in position after they are secured to the panels by means of this finger and slot arrangement, the invention provides locking wings or tabs 29 in the wall sections 17 and 19. As best seen in FIGS. 4 and 5, the tabs may be selectively bent to outwardly overlie the upper edge 30 of the plate to obstruct withdrawal of the fingers from the slots, it being noted that the tabs have beveled bottom edge portions 31 which engage the upper edge 30 so as to urge the plate downward and firmly lock it in position as the tab is bent outward. As can be seen in FIG. 6, the upper and lower attachment holes 27 and 28 are each vertical mirror images of the other such that the panels or guide plate arrangement may be reversed if so desired. Similarly, it should be noted that locking wings or tab portions similar to the tabs 29 can alternatively be provided or formed in the guide plates, said wings or tab portions each being in registry and positionable in an associated slot in the wall section of the edge beam to secure the plates.

From the foregoing it can be seen that by connecting a rapping source such as that shown in U.S. Pat. No. 4,093,431 to the lower beams 10 and 11 as schematically shown at 32 in FIG. 2, the present arrangement permits vibrating or rapping of the panel to dislodge encrustatious of collection dust during the cleaning operation. Specifically, the guide plate arrangement embodied by the invention accommodates laterally spacing the adjacent panels such that upon lateral oscilation of the lower beams 10 and 11 by the rapping source, the vibration of each panel tends to accentuate the vibration of the other panels during the collector cleaning operation. The guide plate arrangement also enhances the rigidity and resistance of the panels to end-to-end bowing. Similarly, by alternating the panels across the breadth of the collector wall, the deflection forces associated with end-to-end twisting or warping of adjacent panels tend to symetrically balance one another about the common vertical plane of the central web sections, thus further assuring proper alignment of the wall within the precipitator. Moreover, the mechanical coupling (the finger and slot arrangement) securing each guide plate to its respective panel essentially eliminates the possibility of the panels warping due to thermal stresses generated by welding during field installation. In this respect, it should be noted that since the mechanical connection is inherently resilient, the susceptiblity of the present arrangement to thermal and fatique fracture such as would be encountered in welded arrangements is similarly reduced, thus further enhancing the service life and maintainability of the electrode assembly.

I claim:

1. A collecting electrode plate assembly for a flow-through housing of an electrostatic precipitator, comprising:

a collecting electrode;

electrode suspension means adapted to be supported by the housing of the precipitator;

said collecting electrode including a plurality of successively aligned similar panels pivotally suspended from said suspension means and spaced apart one from the other for swinging movement of said panels during electrode cleaning operations;

said panels each including a pair of spaced edge beam members and a central web portion extending between and connecting said beam members;

guide means at each juncture of said successive panels including a pair of guide plates disposed in opposed spaced relation on either side of the panels and spanning a respective pair of opposing edge beam members;

slot means in one of said opposing edge beam members associated with each of said plates; and said plates each including a protruding clip portion removably positioned and contained within an associated slot means to mechanically secure the plate to said beam member, thereby aligning and retaining the panels in a common plane.

2. The assembly according to claim 1, and said guide means including a plurality of said plates spaced along the length of each panel.

3. The assembly according to claim 1, and said panels each being of a generally channel shaped configuration with the channel openings of successive panels alternately opening to either side of the collecting electrode.

4. The assembly according to claim 1, and said central web portions of the panels being disposed in a common plane.

5. The assembly according to claim 1, and each of said plates including a central attachment portion overlapping the respective beam member including its associated slot means and a retaining flange extending laterally therefrom and overlapping the opposing beam member; and said clip portion protruding from said central attachment portion along the length of the panel and extending through said slot means to releasably enclasp said beam member and secure the plate thereto.

6. The assembly according to claim 1, and tab means interconnecting said plate and beam member to retain said clip portion in the plate securing position.

7. The assembly according to claim 1, and said beam member including said slot means having an outwardly positionable tab generally longitudinally aligned with said clip portion and engageable with said plate to retain the clip portion in the plate securing position.

8. The assembly according to claim 1, and each of said beam members including a pair of laterally extending wall sections in opposing spaced relation on either side of said central web portion, a transverse edge wall portion extending between and connecting said lateral wall sections to define one edge of the panel, and a connecting wall extending laterally and inwardly from one of said wall sections to said central web portion.

9. The assembly according to claim 8, and each of said plates being of a stamped integral construction including a central attachment section substantially spanning the breadth of the wall section of the respective beam member including its associated slot means, a laterally extending retaining flange section outwardly offset from said attachment section and overlapping the wall section of the opposing beam member, and a rigidifying bent portion connecting said attachment and retaining flange sections; and said clip portion protruding from said attachment section through said slot means and enclasping the wall section of the respective beam member including said slot means to secure the plate to said beam member.

10. The assembly according to claim 8, and each of said plates including a central attachment portion overlapping the wall section of the respective beam member including its associated slot means and a retaining flange extending laterally therefrom and overlapping the wall section of the opposing beam member;

said slot means including a pair of slots in said wall section sized to receive said clip portions; and said clip portions extending through said slots to releasably enclasp said wall section to secure the plate to said beam member.

11. The assembly according to claim 10, and said wall sections including a tab proximate each of said slots, and each of said tabs being selectively cooperative with said slots and clip portions to affix the plate to said beam member.

* * * * *